US005374000A

United States Patent [19]

Matsui et al.

[11] Patent Number: 5,374,000

[45] Date of Patent: Dec. 20, 1994

[54] COP CHANGING MECHANISM FOR A WINDING UNIT

[75] Inventors: Isamu Matsui, Kyoto; Yoshiyasu Maeda, Yamatokooriyama; Yuji Todo, Nagaokakyo; Masaharu Kiriake; Takashi Nakao, both of Uji, all of Japan

[73] Assignee: Murata Kikai Kabushiki Kaisha, Kyoto, Japan

[21] Appl. No.: 6,830

[22] Filed: Jan. 21, 1993

[30] Foreign Application Priority Data

Jan. 30, 1992 [JP] Japan ..... 4-009532[U]
Feb. 7, 1992 [JP] Japan ..... 4-056739

[51] Int. Cl.[5] ..... B65H 67/02
[52] U.S. Cl. ..... 242/35.5 A; 242/128
[58] Field of Search ..... 242/35.5 A, 35.5 R, 242/18 R; 57/274, 281

[56] References Cited

U.S. PATENT DOCUMENTS 4,953,798 9/1990 Tone et al. ..... 242/35.5 A X
5,035,371 7/1991 Grecksch et al. ..... 242/35.5 A X
5,078,329 1/1992 Grecksch et al. ..... 242/35.5 A
5,215,271 6/1993 Kiriake ..... 242/35.5 A

*Primary Examiner*—Stanley N. Gilreath
*Attorney, Agent, or Firm*—Spensley Horn Jubas & Lubitz

[57] ABSTRACT

A cop changing mechanism for a winding unit, for transferring a tray supporting a cop in an upright position from a waiting position to a winding position and removing a tray supporting an empty bobbin away from the winding position is provided with a tray holder for pressing down the tray located at the winding position.

5 Claims, 15 Drawing Sheets

COP CHANGING MECHANISM FOR A WINDING UNIT

BACKGROUND OF THE INVENTION

1. Field of the Invention

The present invention relates to a cop changing mechanism for each of a plurality of winding units of an automatic winder, arranged in a row, for feeding a full cop to a winding position in each winding unit and, at the same time, removing empty bobbin from the winding unit, and also relates to an unwinding assisting device for cops successively fed to a winding position.

2. Related Art Statement

A known automatic winder winds up a plurality of cops produced by, for example, a ring spinning frame successively in a package, such as a cone or a cheese, eliminating defective portions, such as slubs, of the yarns. Such an automatic winder has a plurality of winding units arranged in a row. FIG. 7 shows one of the plurality of winding units.

Referring to FIG. 7, a winding unit 101 is fixedly positioned by a support pipe 102 and a duct 103. A yarn Y unwound from a cop 4 located at a predetermined position in the winding unit travels through a balloon breaker 106, a disk or gate tension device 107 for controlling the tension of the yarn Y and a slub catcher 108 for detecting defective portions in the yarn Y and is taken up on a yarn package 114 rotated by a traverse drum 113. The winding unit 101 is provided with a yarn joining device 115, a suction pipe 116 for taking an upper yarn, namely, a yarn extending from the yarn package, to the yarn joining device 115 and a relay pipe 117 for taking a lower yarn, namely, a yarn extending from the cop, to the yarn joining device 115. An automatic winder has a plurality of such winding units 101. Cops 4 are supported in an upright position respectively on trays 5 arranged on a cop feed conveyor 1. Each tray 5 supporting the cop 4 is transferred from the cop feed conveyor 1 through a cop changing mechanism 3 to a winding position 11 to replace an empty bobbin 8, and then the empty bobbin 8 is transferred from the winding position 11 through the cop changing mechanism 3 onto an empty bobbin conveyor 2.

The cop changing mechanism 3 is such as disclosed in Japanese Patent Laid-open (Kokai) No. Sho 59-69370. The cop changing mechanism 3 will be described with reference to FIGS. 8 and 9. FIG. 8 shows one of a plurality of winding units 101 arranged at regular intervals in a row perpendicular to the paper. A cop feed conveyor 1 is extended along the row of the winding units 101, an empty bobbin discharging conveyor 2 is extended along the row of the winding units 101, and cop changing mechanisms 3 are disposed between the cop feed conveyor 1 and the empty bobbin discharging conveyor 2. The cop feed conveyor 1 conveys trays 5 respectively supporting cops 4. Each tray 5 has the shape of a hollow disk and is provided coaxially with a stepped portion 6. A peg 7 is set upright on the stepped portion 6. The take-up tube 8 of the cop 4 is put on the peg 7 so that the cop 4 is held in an upright position on the stepped portion 6. A through hole 10 is formed in the upper end of the peg 7 so that the interior of the tray 5 communicates with the center bore 9 of the take-up tube 8 by means of the through hole 10. The free end Y of the yarn of the cop 4 is suspended in the bore 9 of the bobbin 8 from the upper end of the take-up tube 8. The cop feed conveyor 1 and the empty bobbin discharging conveyor 2 are extended, respectively on different levels, and the cop changing mechanism 3 is disposed along a slope between the cop feed conveyor 1 and the empty bobbin discharging conveyor 2. The cop 4 is transferred from the cop feed conveyor 1 to a winding position 11 in the cop changing mechanism 3, the yarn of the cop 4 is taken up on a yarn package, not shown, by the winding unit 101, and the empty bobbin 8 is transferred from the winding position onto the empty bobbin discharging conveyor 2.

Referring to FIG. 9 showing the cop changing mechanism 3, a first guide plate 13 and a second guide plate 14 are disposed fixedly in the winding unit 101 so as to form a bent passage 12 along which the tray 5 travels. An inclined rotary disk 15 defines the lower surface of a feed passage 12*a*, and a portion of the first guide plate 13 is bent to form a bottom plate 16 defining the lower surface of an ejecting passage 12*b*. The cop feed conveyor 1, the inclined rotary disk 15, the bottom plate 16 of the first guide plate 13 and the empty bobbin discharging conveyor 2 are included substantially in a plane. The inclined rotary disk 15 is partially in contact with the cop feed conveyor 1 and is driven for turning in the direction of the arrow a on a shaft 17. A third guide plate 18 is disposed in connection with the cop feed conveyor 1 to guide some of the trays 5 being conveyed in the direction of the arrow b by the cop feed conveyor 1 into the feed passage 12*a* and to allow the rest of the trays 5 to be conveyed further in the direction of the arrow b.

A stopper lever 20 provided at its free end with a free roller 19 is supported for swing motion by a shaft 21 on the first guide plate 13. The stopper lever 20 is biased in the direction of the arrow c by a spring 22 and the turning of the stopper lever 20 in the direction of the arrow c is limited by a pin 23. The stopper lever 20 has a projecting portion 25 that projects into the outlet of a first bend of the passage 12 defining a waiting position 24 to restrict the width of the outlet of the waiting position 24 to a width smaller than the diameter of the stepped portion 6 of the tray 5 when the stopper lever 20 rests on the pin 23 to keep two trays 5 always in the feed passage 12*a*.

An ejecting lever 26 is supported for turning by a shaft 28 on the second guide plate 14. The ejecting lever 26 has a recess 31 for receiving the stepped portion 6 of the tray 5 to hold the tray at the winding position 11 corresponding to a second bent portion of the passage 12, and a roller operating edge 32 having the shape of an arc of a circle having its center on the center axis of the shaft 28. As shown in FIG. 8, the shaft 28 of the ejecting lever 26 is turned by a rocking arm, not shown, reciprocated by a push rod 44 moved vertically by tray moving cams 43.

Since the winding position 11 is located on the inclined rotary disk 15, the inclined rotary disk 15 is provided with a plurality of circular slots 34 having the shape of a circular arc having their centers on the center axis of the shaft 17. When the tray 5 is located at the winding position 11, the center axis of the peg 7 coincides with the circular slot 34. As shown in FIG. 8, a nozzle 35 for blowing compressed air through the circular slot 34 into the bore of the peg 7 is disposed under the inclined rotary disk 15. The nozzle 35 is connected via a valve 38 controlled by a lever 37 for opening and closing to an air hose 36. When a shaft 39 is turned to open the valve 38, air supplied through the air hose 36 is blown from the nozzle 35 through the circular slot 34, the interior of the tray 5 and the through hole 10 of the peg 7 into the center bore 9 of the bobbin 8 to blow the free end Y1 suspended in the center bore 9 upward and, consequently, the free end Y1 is blown up through the balloon breaker 106 of the winding unit 101 and is caught by suction by a suction pipe, not shown, disposed above the balloon breaker 106. Then, the free end Y1 is pieced to the free end of the yarn being wound on the package, not shown. The shaft 39 of the lever 37 is turned by the rocking arm, not shown, reciprocated by the push rod 45 moved vertically by the tray moving cam 43.

The operation of the prior art cop changing mechanism 3 will be described hereinafter. Referring to FIG. 9 showing the cop changing mechanism 3 in a state for the normal winding operation, a first tray 5*a* is located at the winding position 11, and a second tray 5*b* and a third tray 5*c* are stored at the waiting position 24 in the feed passage 12*a*. The stepped portion 6 of the first tray 5*a* located at the winding position 11 is received in the recess 31 of the ejecting plate 26, and the projecting portion 25 of the stopper lever 20 is in contact with the stepped portion 6 of the second tray 5*b* stored at the waiting position 24 so that the second tray 5*b* will not be moved to the winding position 11 by the rotary disk 15.

Upon the exhaustion of the cop 4 supported on the first tray 5*a*, the cam tray 43 of the winding unit 101 turns the shaft 28 through a fixed angle together with the ejecting lever 26 holding the first tray 5*a* in the recess 31 counterclockwise as shown in FIG. 10 to eject the first tray 5*a* through the ejecting passage 12*b* onto the empty bobbin discharging conveyor 2. As the ejecting lever 26 is turned counterclockwise, the roller operating edge 32 engages the free roller 19 supported on the stopper lever 20 to shift the projecting portion 25 of the stopper lever 20 to the left, so that the second tray 5*b* is allowed to be brought into contact with the roller operating edge 32 of the ejecting lever 26 by the inclined rotary disk 15 continuously and frictionally rotated by the cop feed conveyor 1.

Upon the restoration of the ejecting lever 26 to its initial position, the stopper lever 20 is allowed to its initial position as shown in FIG. 9 and the second tray 5*b* drops into the recess 31 of the ejecting lever 26 located at the winding position 11. At the same time, the shaft 39 (FIG. 8) is turned so as to open the valve 38 to blow compressed air through the nozzle 35 through the circular slot 34 of the inclined rotary disk 15 and the through hole 10 of the peg 7 into the bore of the take-up tube 8 and, consequently, the free end Y1 of the yarn is blown up to the suction pipe. Then, the winding operation is restarted.

In winding the yarn by the winding unit shown in FIG. 8, the absolute value and the amplitude of variation of the yarn tension increases sharply after the amount of yarn on a cop has decreased to a value about ⅓ of that of the yarn of a full cop, namely, after a full cop has reduced to a nearly exhausted cop generally called a ⅓ cop (skinny bobbin), and, in the worst case, the yarn is broken. Furthermore, when the winding speed is increased, sluffing, namely, unstable unwinding of the yarn from the chase 4*a* of the cop 4 and simultaneous removal of a plurality of coils of yarn from the cop 4, is liable to occur frequently. Increase in the yarn tension and the occurrence of sluffing is dependent on the mode of unwinding of the yarn from the cop 4. A previously proposed method of suppressing increase in the tension of the yarn and the occurrence of sluffing to increase the winding speed limits the size of the balloon of the unwound yarn by a balloon breaker 106 having the shape of a cylinder and provided with a restricting portion and lowers the balloon breaker 106 gradually in the direction of the arrow h as the yarn of the cop 4 decreases. It is found that the balloon breaker 106 suppresses the balloon most effectively when the size e of an annular space formed between the inner circumference of the balloon breaker 106 and the outer circumference of the take-up tube 8 is reduced to the least possible extent. However, the cop 4 must be located at the winding position 11 in a position substantially perpendicular to the inclined rotary disk 15 and a reference plane A defined by the bottom plate 16 to reduce the size e of the annular gap.

However, since the height of the tray 5 is smaller than size of the gap between the inclined rotary disk 15 and the second guide plate 14 in the cop changing mechanism 3 shown in FIG. 8, the weight of the cop 4 tends to tilt the tray 5 and hence it is difficult to hold the cop correctly at the winding position 11 in a position perpendicular to the reference plane A.

OBJECT AND SUMMARY OF THE INVENTION

The present invention has been made in view of the foregoing problems in the prior art and it is therefore an object of the present invention to provide a cop changing mechanism capable of accurately holding a cop at a winding position in a position perpendicular to a reference plane.

It is another object of the present invention to provide an unwinding assisting device for an automatic winder, capable of enabling a yarn to be unwound properly from the chase of a cop and of maintaining an optimum balloon.

To achieve the object, the present invention provides a cop changing mechanism for transferring a tray supporting a full cop in an upright position from a waiting position to a winding position and moving a tray supporting an empty bobbin in an upright position away from the winding position, provided with a tray holder extending downward to press down a tray at the winding position.

The tray holder presses down a tray at the winding position, the bottom surface of the tray can be held in place in close contact with a reference plane.

The present invention provides an unwinding assisting device for an automatic winder, comprising a lifting mechanism for holding a tray supporting a cop in an upright position at a winding position and raising the tray as the yarn is unwound from the cop, and a tubular member for receiving the bobbin of the cop, having an inside diameter smaller than the outside diameter of a full cop and greater than the outside diameter of the take-up tube.

The lifting mechanism raises the cop as the yarn is unwound from the cop to maintain the distance between the tubular member and the chase of the cop constant so that a constant balloon is formed by the tubular member.

DETAILED DESCRIPTION OF PREFERRED EMBODIMENT

Figure 1:
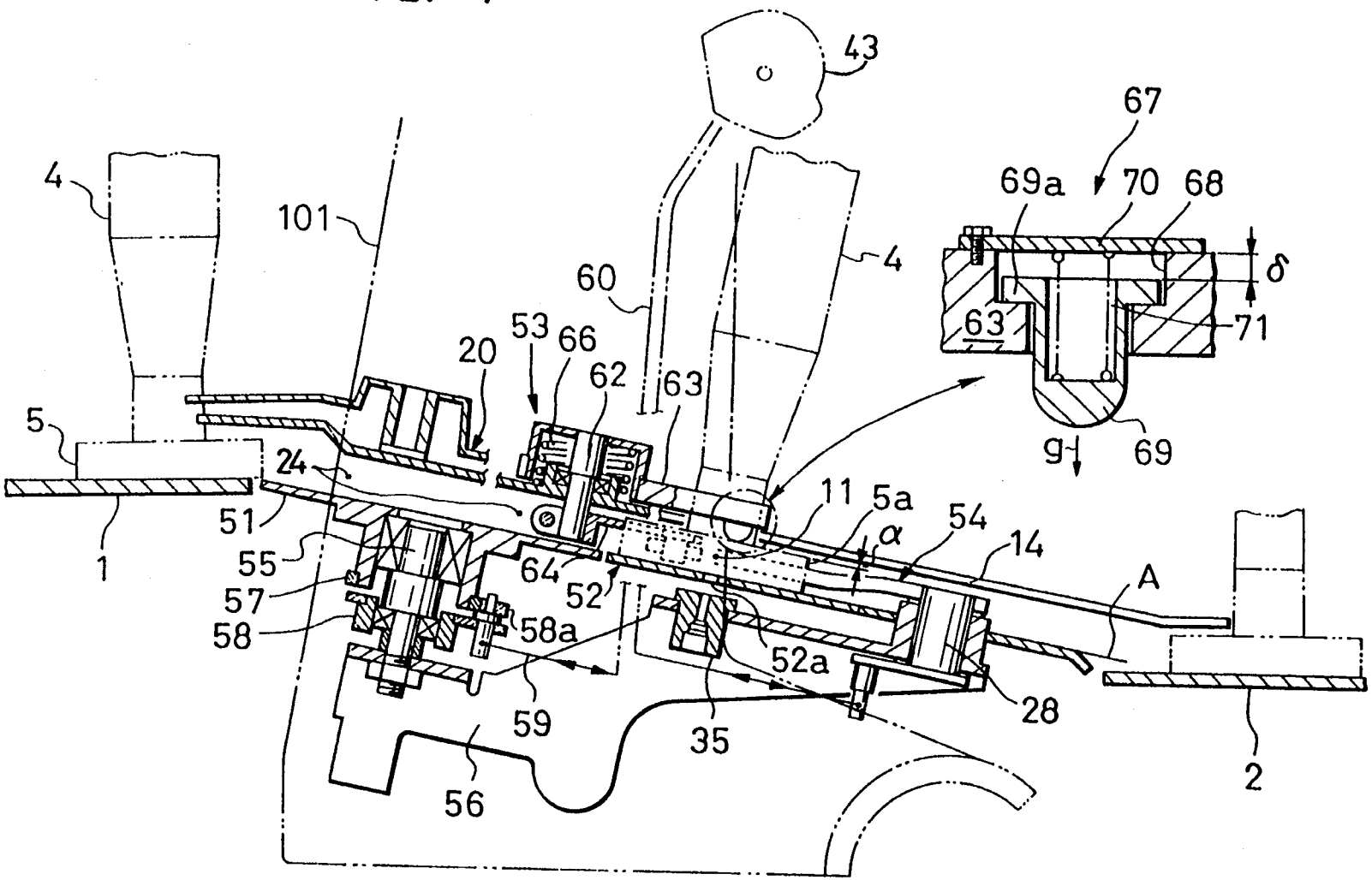
FIG. 1 is a side view of a cop changing mechanism in a preferred embodiment according to the present device.

A cop changing mechanism in a preferred embodiment according to the present device will be described hereinafter with reference to the accompanying drawings. FIG. 1 is a side view of the cop changing mechanism of the present device and FIG. 2 is a top plan view of the cop changing mechanism of FIG. 1.

Figure 2:
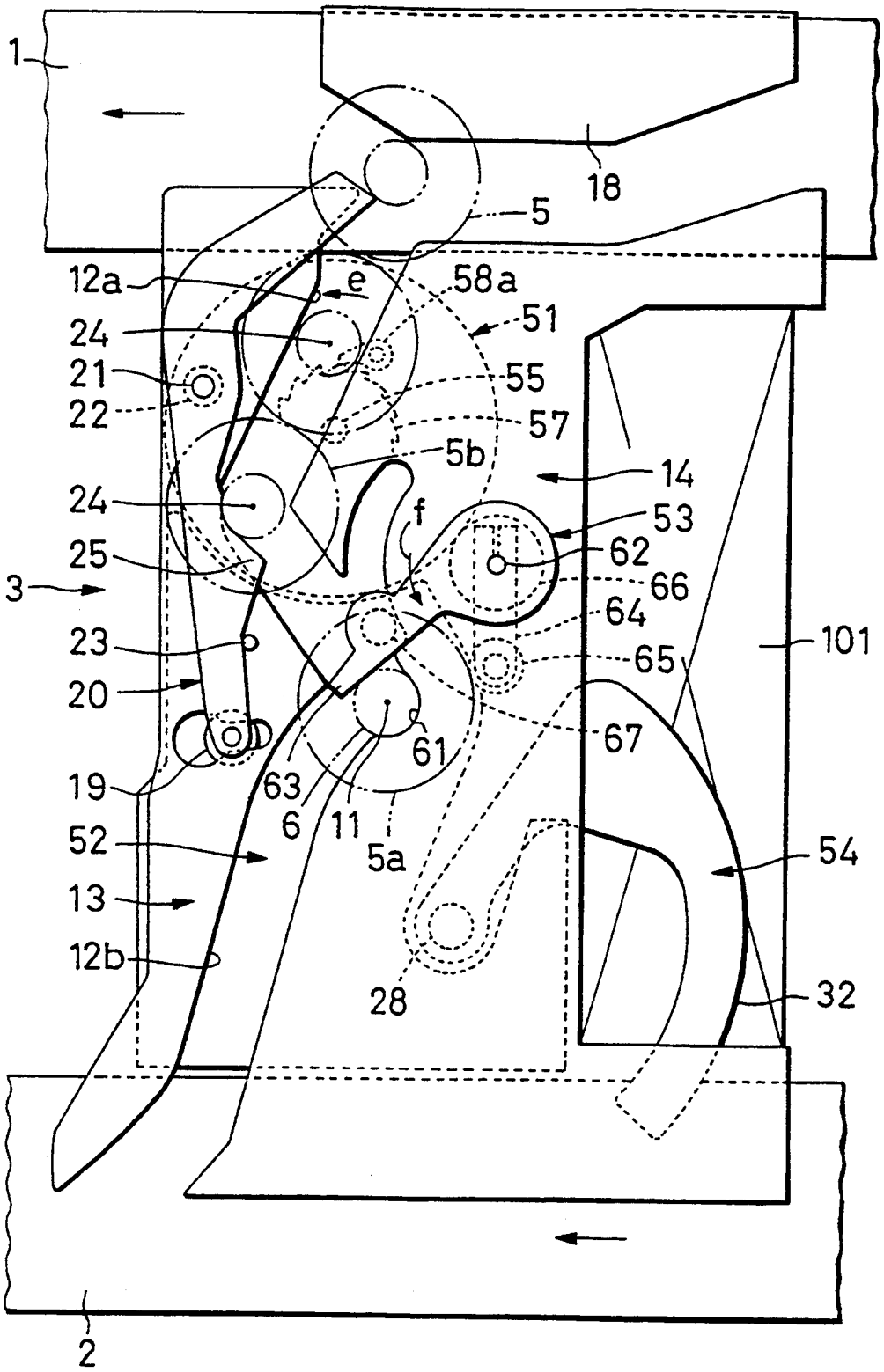
FIG. 2 is a plan view of the cop changing mechanism of FIG. 1.
Figure 8:
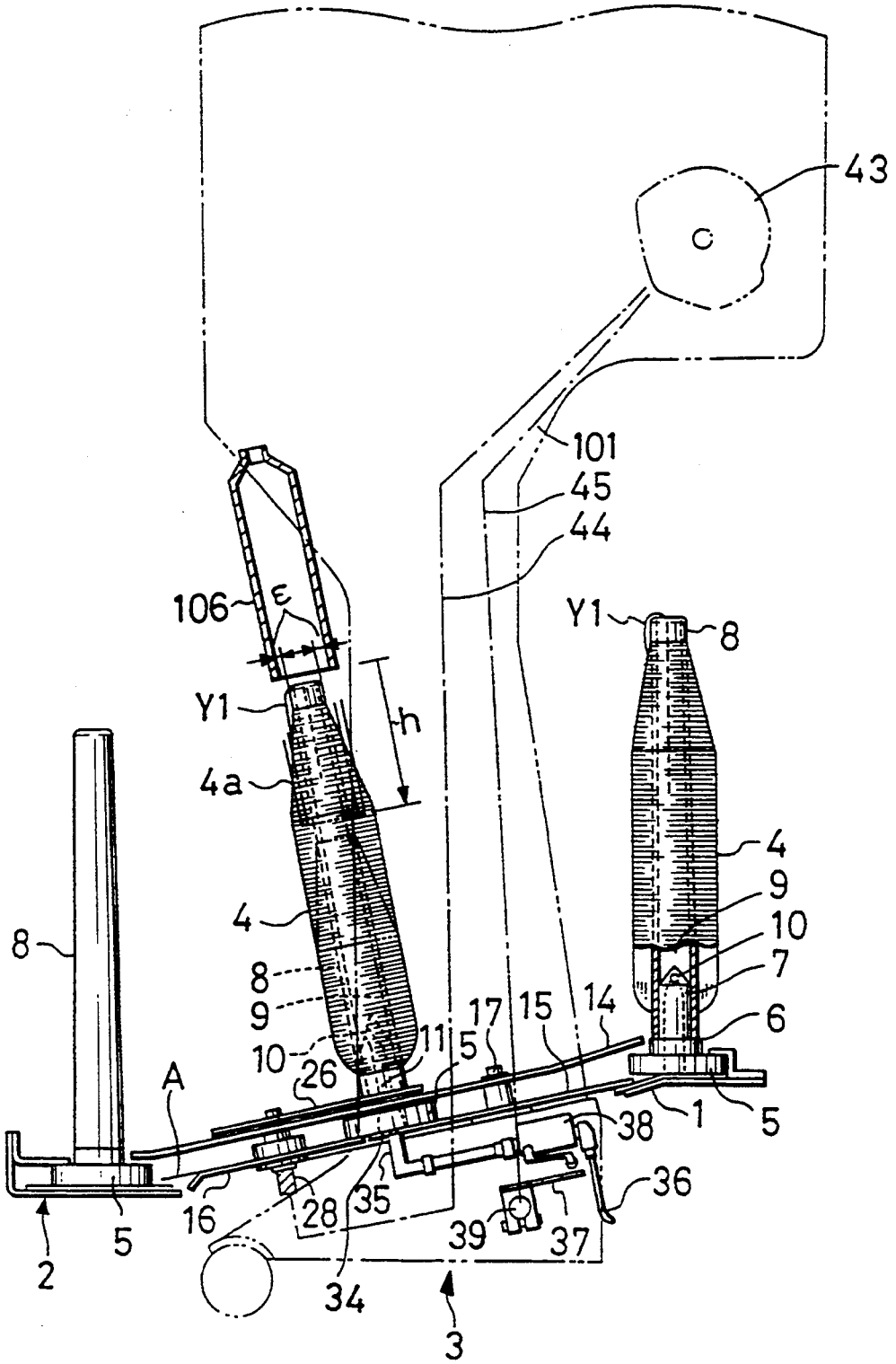
FIG. 8 PRIOR ART
FIG. 8 is a side view of a prior art cop changing mechanism.
Figure 9:
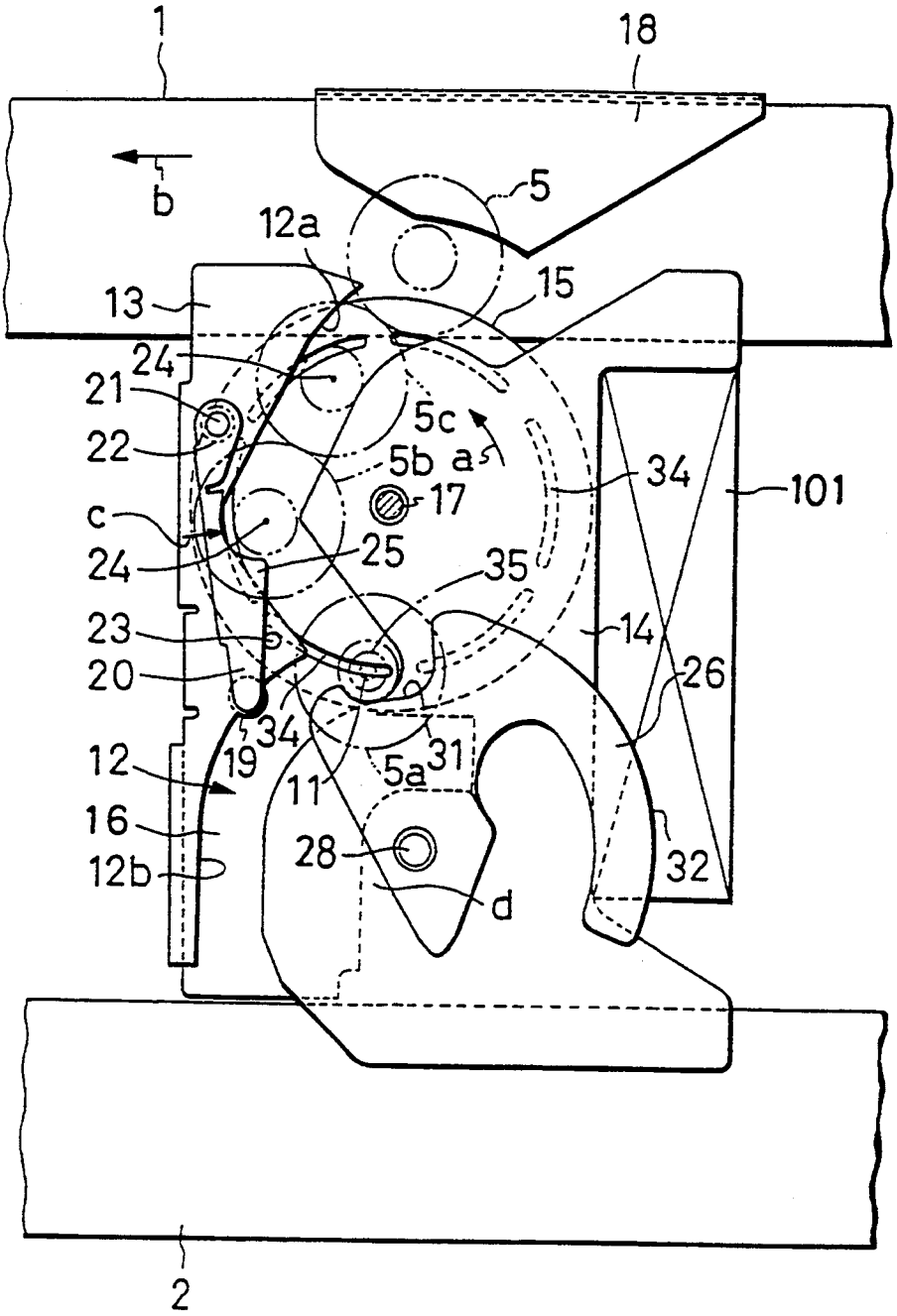
FIG. 9 PRIOR ART
FIG. 9 is a plan view of the prior art cop changing mechanism of FIG. 8.
Figure 10:
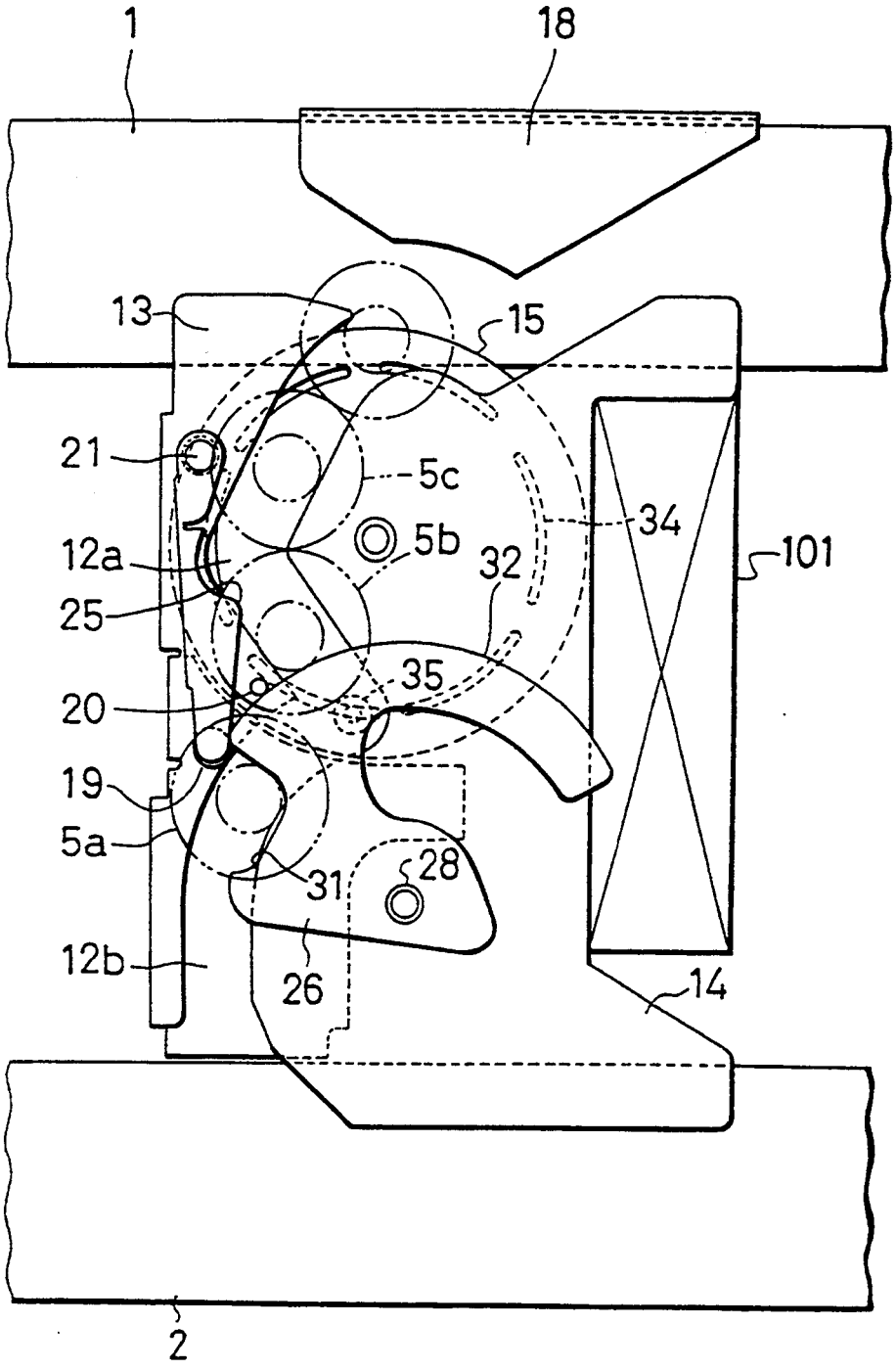
FIG. 10 PRIOR ART
FIG. 10 is a plan view of the cop changing mechanism of FIG. 8 in one phase of operation.

FIGS. 1 and 2 show the cop changing mechanism of the present device, in which parts like or corresponding to those shown in FIGS. 8 and 9 are denoted by the same reference characters and the description thereof will be omitted. Principal differences between the cop changing mechanism of the present device and the prior art cop changing mechanism shown in FIGS. 8 and 9 will be described. Referring to FIGS. 1 and 2, a first ejecting lever 53 provided with a tray holder 67 is supported on a second guide plate 14, an inclined rotary disk 51 is smaller than that of the prior art cop changing mechanism, the size of a bottom plate 52 is larger than that of bottom plate of the prior art cop changing mechanism, and the shape of a second ejecting lever 54, which corresponds to the ejecting lever of the prior art cop changing mechanism, is different from that of the ejecting lever of the prior art cop changing mechanism.

Referring to FIG. 1, the inclined rotary disk 51 is separated from both a cop feed conveyor 1 and a winding position 11, and has two waiting positions 24. The inclined rotary disk 51 is supported for rotation on a shaft 55 fixed to a bracket 56 projecting from a winding unit 101. A ratchet wheel 57 having a plurality of teeth is attached to the lower surface of the inclined rotary disk 51. A rotary plate 58 pivotally supporting a click 58*a* is supported for rotation on the shaft 55. A link 59 pushes and pulls the rotary plate 58 to turn the ratchet wheel 57 together with the inclined rotary disk 51 in the direction of the arrow e to move a tray obliquely downward, as viewed in FIG. 1. A push rod 60 reciprocates the link 59 to turn the inclined rotary disk 51 intermittently. The push rod 60 is moved vertically by a tray moving cam 43 included in the winding unit 101 to push and pull the link 59 through a rocking arm, not shown.

As shown in FIG. 2, the bottom plate 52 has a size large enough to support a tray 5*a*. The tray 5*a* is held at the winding position 11 by the cooperative action of a recess 61 formed in the second guide plate 14, and the first ejecting lever 53. The second ejecting lever 54 disposed between the bottom plate 52 and the second guide plate 14 has a roller operating edge 32 and is not provided with any recess corresponding to the recess 31 (FIG. 7) for holding the tray 5*a* in place.

As shown in FIG. 2, the first ejecting lever 53 is fixed to a shaft 62 journaled on the second guide plate 14. A first arm 63 is fixed to the upper end of the shaft 62. A second arm 64 extending in a space between the bottom plate 52 and the second guide plate 14 is fixed to the lower end of the shaft 62. A free roller 65 to be operated by the roller operating edge 32 of the second ejecting lever 54 is supported on the extremity of the second arm 64. A spring 66 extended between the first arm 63 and the second guide plate 14 biases the first arm 63 and the second arm 64 in the direction of the arrow f.

When the tray 5*a* is located at the winding position 11, the first arm 63 presses the stepped portion 6 of the tray 5*a* against the recess 61 of the second guide plate 14. The first arm 63 is provided with a tray holder 67 for holding the tray 5*a*. As shown in FIG. 1, the tray holder 67 comprises a pressing member 69 provided with a flange 69a and received in a stepped hole 68 formed in the first arm 63, a cover member 70, and a compression spring 71 compressed between the pressing member 69 and the cover member 70. The pressing member is biased always in the direction of the arrow g by the compression spring 71 and is capable of being retracted by a distance $\delta$. The extremity of the pressing member 69 is brought into contact with the upper surface of the tray 5*a* to press down the tray 5*a*. Thus, although the bottom plate 52 is inclined and there is a gap of a size $\alpha$ between the second guide plate 14 and the upper surface of the tray 5*a*, the tray 5*a* is not tilted by the weight of a cop 4 and the bottom surface of the tray 5*a* is kept in close contact with the bottom plate 52.

The operation of the cop changing mechanism 3 will be described hereinafter. Referring to FIG. 2 showing the components of the cop changing mechanism 3 in an arrangement for winding operation, a first tray 5*a* is located at the winding position 11 on the bottom plate 52, and a second tray 5*b* and a third tray 5*c* are located, respectively, at the waiting positions 24 in the feed passage 12*a*. The stepped portion 6 of the first tray 5*a* is held between the recess 61 of the second guide plate 14 and the first lever 63 of the first ejecting lever 53. The second tray 5*b* is restrained from downward movement by the projection 25 of the stopper lever 20 engaging the stepped portion 6 of the second tray 5*b*. In this state, the inclined rotary disk 51 is stationary.

Figure 3:
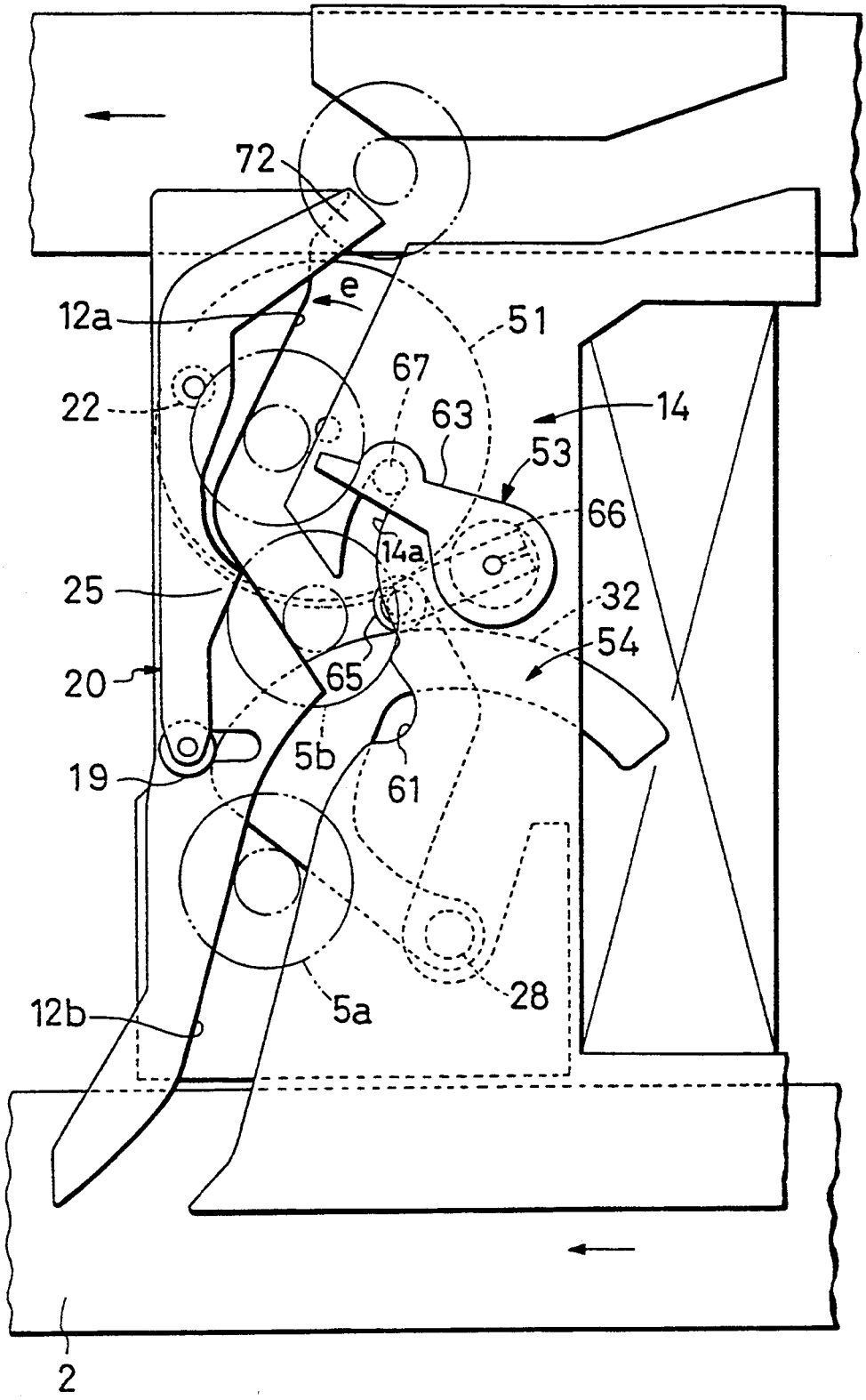
FIG. 3 is a plan view of the cop changing mechanism of FIG. 1 in one phase of operation.

Upon the exhaustion of the cop 4 supported on the first tray 5*a* located at the winding position 11, a tray moving cam 43 (FIG. 1) of the winding unit 101 turns the shaft 28 through a fixed angle. Consequently, the second ejecting lever 54 is turned counterclockwise to push out the first tray 5*a* from the recess 61 of the second guide plate 14 into the discharge passage 12*b* as shown in FIG. 3 and transfers the tray 5*a* onto the empty bobbin discharging conveyor 2. As the second ejecting lever 54 is turned counterclockwise, the roller operating edge 32 of the second ejecting lever 54 engages the free roller 65 to shift the first arm 63 of the first ejecting lever 53 to a retracted position as shown in FIG. 3. A slot 14*a* is formed in the second guide plate 14 to enable the tray holder 67 to move without being obstructed. The roller operating edge 32 engages the free roller 19 of the stopper lever 20 to move the projection 25 of the stopper lever 20 to the left so that the second tray 5*b* is released from the projection 25. Then, second tray 5*b* is moved by the intermittently moving inclined rotary disk 51 as far as the stepped portion 6 thereof is brought into contact with the roller operating edge 32. The inclined rotary disk 51 is turned intermittently through the push rod 60, the link 59, the rotary plate 58, the click 58*a* and the ratchet wheel 57 by the tray moving cam 43 (FIG. 1) of the winding unit 101. A projection 72 formed on the other end of the stopper lever 20 opposite the end in which the free roller 19 is supported projects to prevent another tray 5 from entering the feed passage 12*a*.

Upon the return of the second ejecting lever 54 to its initial position, the stopper lever 20 is returned to its initial position by a spring 22, and the spring 66 biases the second ejecting lever 54 toward its initial position. The first arm 63 of the second ejecting lever 54 moves the second tray 5*b* released from the roller operating edge 32 into the recess 61 of the second guide plate 14 located at the winding position 11, and then the tray holder 67 (FIG. 1) is turned onto the second tray 5*b* to press the second tray 5*b* against the bottom plate 52 so that the bottom surface of the second tray 5*b* is held in close contact with the bottom plate 52 to hold the cop 4 supported on the second tray 5*b* in a position perpendicular to the reference plane A. Thus, the cop 4 can be held in a correct position when the bottom plate 52 having the upper surface serving as the reference plane A is disposed in a high accuracy. Upon the return of the second ejecting lever 54 to its initial position, compressed air is blown through the nozzle 35 (FIG. 1) to blow up the free end, not shown, of the yarn of the cop 4 to enable the suction pipe, not shown, is able to such in the free end of the yarn, and then the winding operation is started. The nozzle 35 blows compressed air through a hole 52*a* formed in the fixed bottom plate 52 instead of the circular slots 34 formed in the rotating inclined rotary disk 15, so that compressed air is blown into the tray 5*b* without fail.

Figure 4:
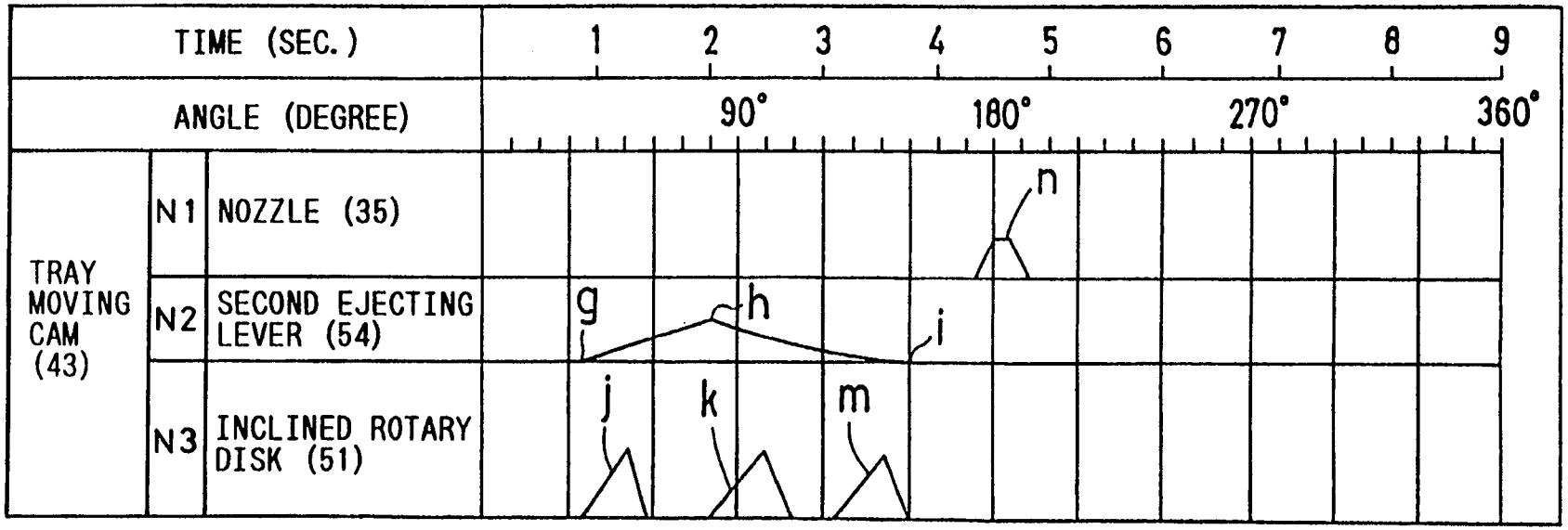
FIG. 4 is a timing chart of assistance in explaining the intermittent turning of an inclined rotary disk.

The timing of the intermittent turning of the inclined rotary disk 51 will be described hereinafter with reference to FIG. 4. A curve N1 indicates the timing of driving the nozzle 35, a curve N2 indicates the timing of driving the second ejecting lever 54 and a curve N3 indicates the timing of turning the inclined rotary disk 51. First, the second ejecting lever 54 is turned from a point g to a point h to move the empty bobbin away from the winding position while the ratchet wheel is turned for the first time to turn the inclined rotary disk 51 through a predetermined angle as indicated by a triangle j. Then, the second ejecting lever 54 is returned from the point h to the initial position represented by a point i while the inclined rotary disk 51 is turned through the predetermined angle for the second time as indicated by a triangle k and through the predetermined angle for the third time as indicated by a triangle m . Then, as shown in FIG. 3, the tray 5 is advanced as far as the stepped portion 6 of the tray comes into contact with the roller operating edge 32 of the second ejecting lever 54, and then compressed air is blown from the nozzle 35 at a point n to blow up the free end of the yarn for yarn joining.

Figure 5:
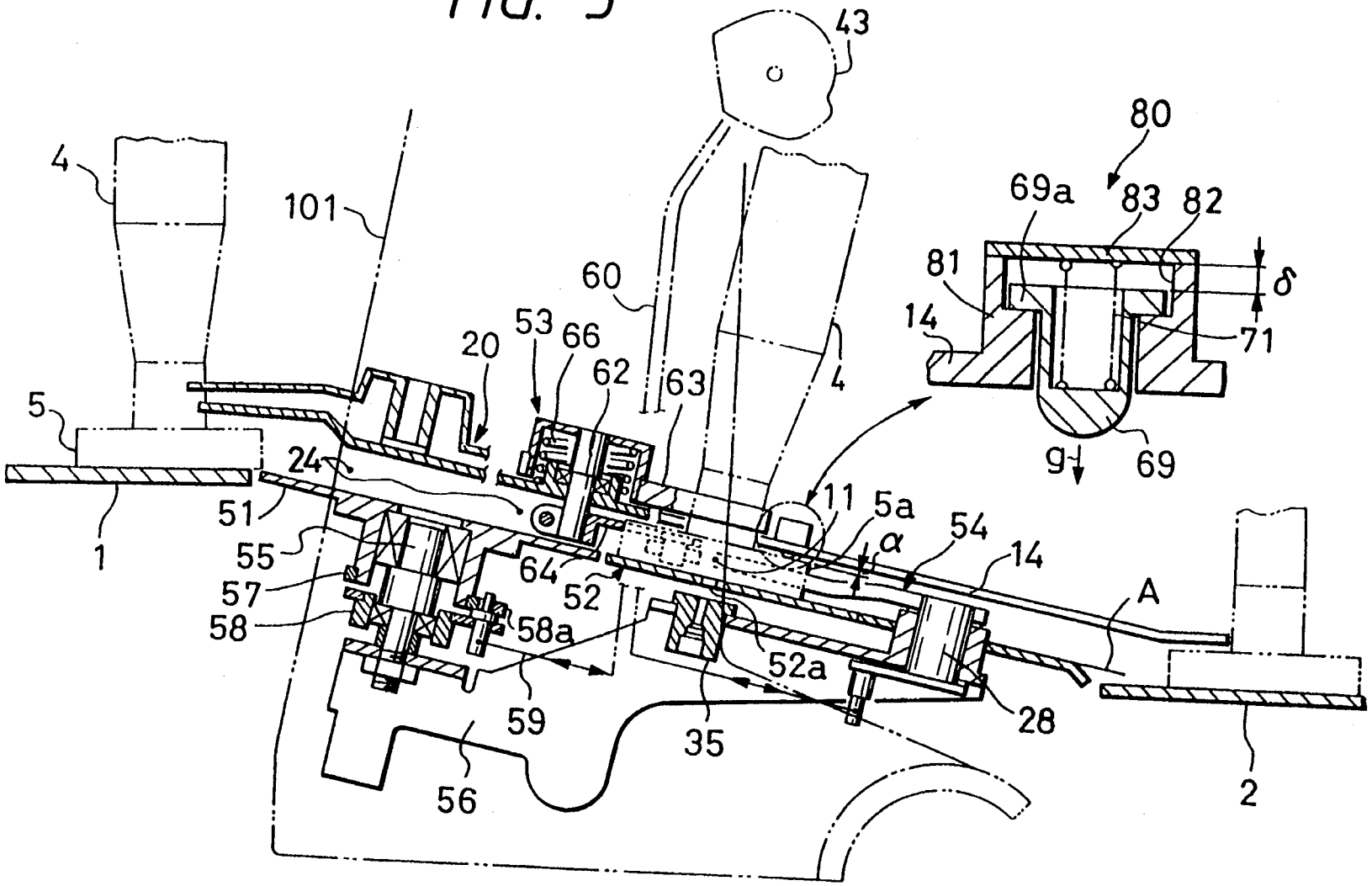
FIG. 5 is a side view of a cop changing mechanism in another embodiment according to the present device.
Figure 6:
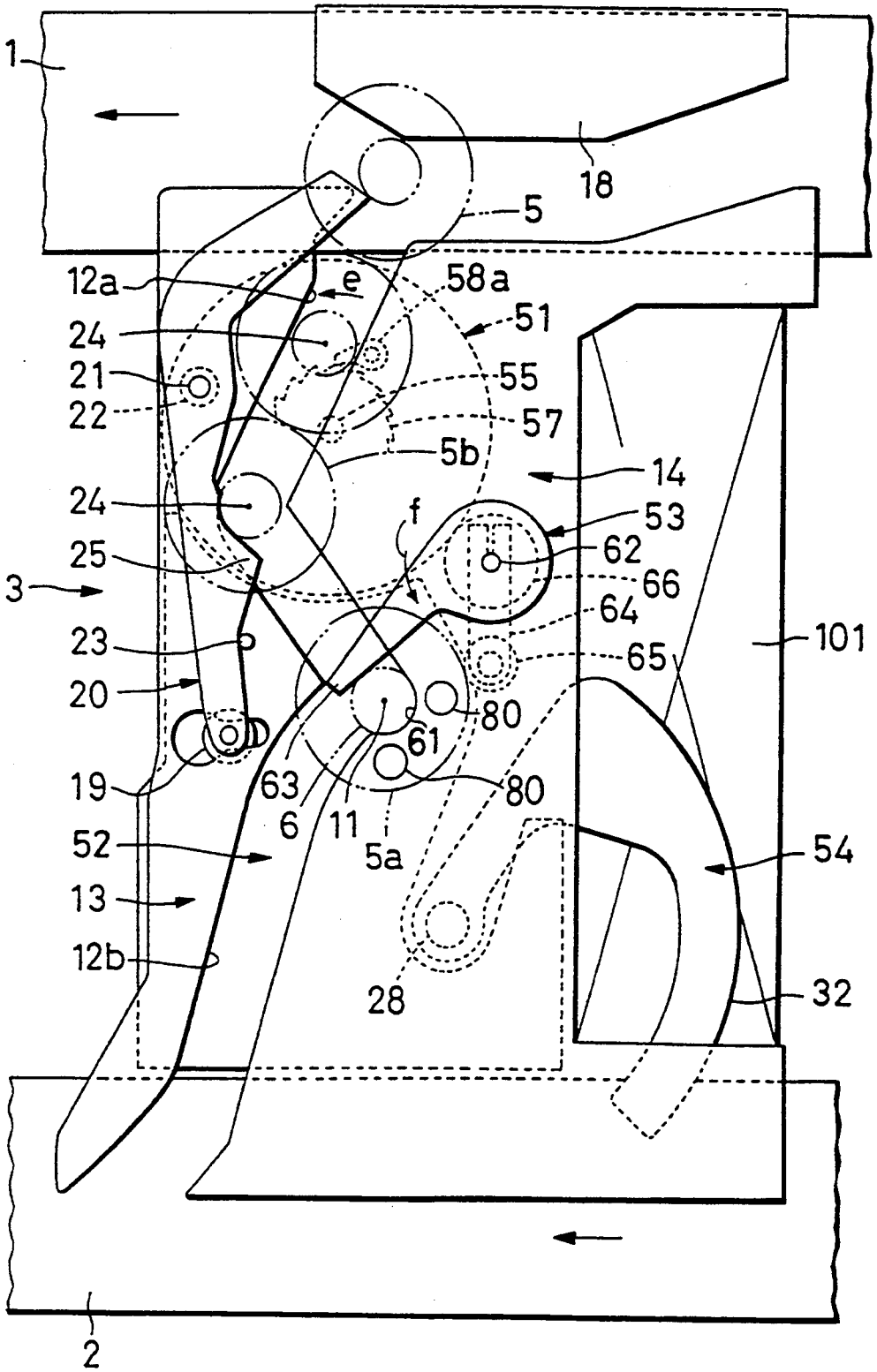
FIG. 6 is a plan view of the cop changing mechanism of FIG. 5.

The tray holder need not necessarily be provided on the first ejecting lever 53; the same may be provided on the second guide plate 14. In a modification shown in FIGS. 5 and 6, two tray holders 80 are provided on the second guide plate 14. As best shown in FIG. 5, each tray holder 80 comprises a housing 81 provided with a stepped hole 82 and fastened to the upper surface of the second guide plate 14, a pressing member 69 placed in the stepped hole 82, a spring 66 are placed in the stepped hole 82, and a cover member 83 put on the housing 81 to hold the pressing member 69 and the spring 66 in the stepped hole 82. As shown in FIG. 5, the extremity of the pressing member 69 is in contact with the upper surface of a tray 5*a*. As shown in FIG. 6, the two tray holder 80 are disposed, respectively, at two positions on the second guide plate 14 so that the tray holders 80 will not interfere with the free roller 65 of the first ejecting lever 53. The tray holders 80 do not interfere with the second ejecting lever 54 because the second ejecting lever 54 is on a level below the extremities of the pressing members 69.

The tray holder for pressing down the tray located at the winding position is the feature of the present device. The tray holder may be provided on second guide plate of the prior art cop changing mechanism shown in FIGS. 8 and 9.

The cop changing mechanism of the present device for a winding unit, for transferring a tray supporting a cop in an upright position from the waiting position to the winding position, and moving a tray supporting an empty bobbin in an upright position away from the winding position is characterized by the tray holder for pressing down the tray located at the winding position. The tray holder presses down the tray so that the bottom surface of the tray is held in close contact with the reference plane, so that the cop can accurately be held in a position perpendicular to the surface of the bottom plate serving as the reference plane. The tray holder prevents the cop from being tilted by its own weight with effect particularly when the bottom plate is inclined.

As mentioned above, the productivity of the winding unit 1 is greatly dependent on the winding speed. The practical winding speed of a prior art automatic winder is on the order of 1000 m/min, because the tension of the yarn increases with increase in the winding speed and the tension of the yarn increases sharply after the amount of yarn of the cop has decreased to $\frac{1}{3}$ of that of the yarn of a full cop and, in the worst case, the yarn is broken.

Figure 7:
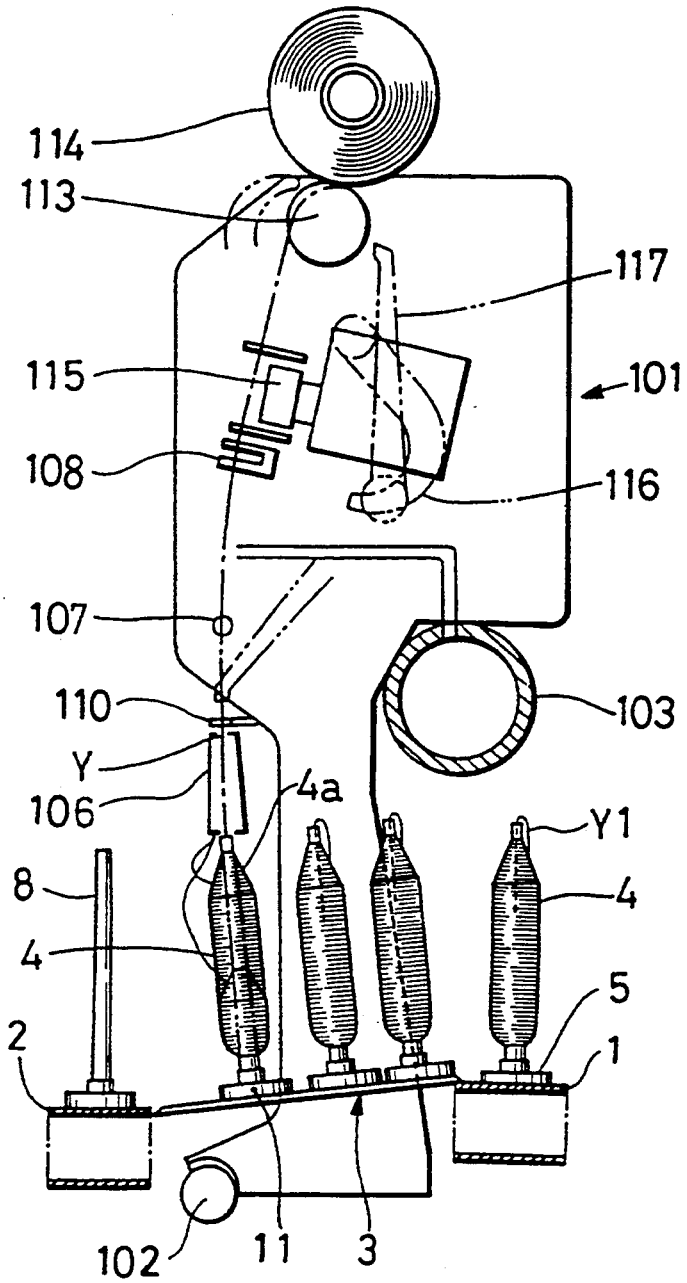
FIG. 7 PRIOR ART
FIG. 7 is a schematic side view of a prior art winding unit.

The dependence of increase in the tension of the yarn being unwound on the condition of unwinding the yarn from the cop has empirically been known. Therefore, as shown in FIG. 7, the balloon of the yarn being unwound from the cop 4 is controlled by a tubular member 106 so that an excessively large balloon may not be formed. Since the tubular member 6 is disposed under a guide plate 110 and above the cop 4 and fixed to a frame, the distance between the chase 4*a* of the cop 4 and the lower end of the tubular member 106 increases gradually as the yarn of the cop 4 is unwound, reducing the balloon control effect of the tubular member 6. A previously proposed unwinding assisting device lowers the tubular member 106 gradually as the yarn of the cop is unwound.

As the tubular member 106 is lowered toward the bobbin of the cop, the distance between the upper end of the tubular member 106 and the guide plate 110 increases and, consequently, the balloon formed between the upper end of the tubular member 106 and the guide plate 110 is uncontrolled and hence increase in the tension of the yarn cannot satisfactorily be suppressed.

The present invention has been made in view of the foregoing problems and it is therefore an object of the present invention to provide an unwinding assisting device for an automatic winder, capable of enabling a yarn to be unwound properly from the chase of a cop and of maintaining an optimum balloon.

Figure 11:
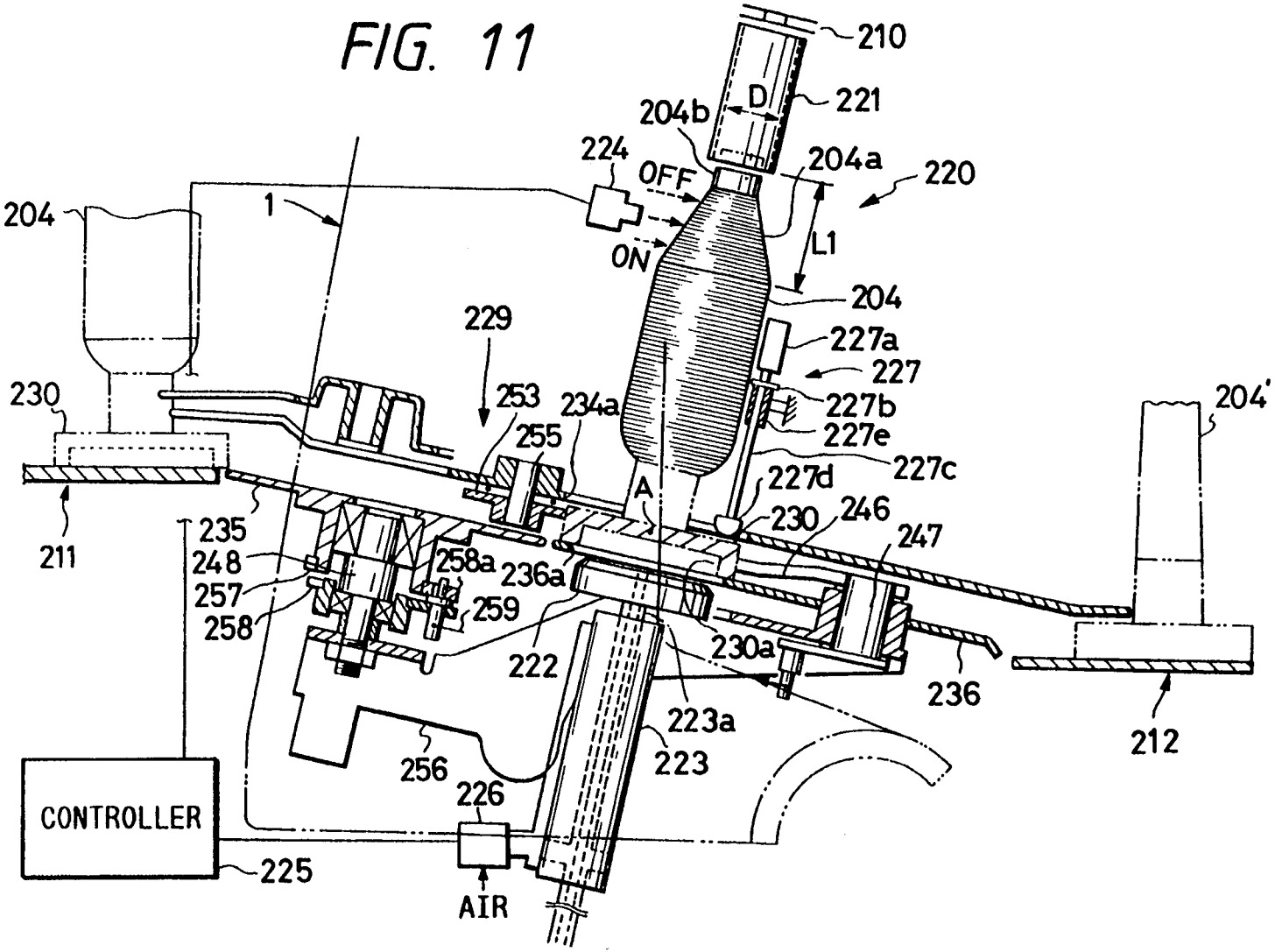
FIG. 11 is a side view of an unwinding assisting device embodying the present invention.

Another embodiment of the present invention will be described with reference to the accompanying drawings. FIG. 11 is a side view of an unwinding assisting mechanism according to the present invention.

Referring to FIG. 11, an unwinding assisting device 220 comprises, as principal components, a tubular member 221, a lifting mechanism comprising a disk 222, a cylinder actuator 223, a sensor 224 and a controller 225, and a tray holder 227 for holding a tray 230.

The tubular member 221 having the shape of a circular cylinder having open upper and lower ends extends between a guide plate 210 and a cop 204 located at a winding position A. The tubular member 221 is disposed coaxially with the cop 204 and fastened to a frame, not shown. In starting unwinding the yarn of a cop 204, the lifting mechanism lifts up the cop 204 to insert the upper end of the take-up tube **204*b* of the cop 204 in the lower end of the tubular member 221 as indicated by alternate long and two short dashes lines and raises the cop 204 gradually to insert the take-up tube 204*b* deeper into the tubular member 221 as the yarn of the cop 204 is unwound so that the distance L1 between the lower end of the tubular member 221 and the lower end of the chase 204*a* remains substantially constant. The tubular member 221 controls a balloon formed by the yarn unwound from the chase 204*a*** in an appropriate size so that the unwinding angle is large to suppress the occurrence of sluffing and fluffing.

The relation of the inside diameter D of the tubular member 221 and the size of the cop 204 is important to enable the tubular member 221 to carry out its utmost function. The inside diameter D of the tubular member 221 must be smaller than the outside diameter of the cop 204 and greater than the outside diameter of the take-up tube **204*b* of the cop 204. Preferably, the tubular member 221 is as close as possible to the take-up tube 204*b***.

The disk 222 is attached to the free end of the rod **223*a* of the cylinder actuator 223 and is disposed at the winding position A to raise the cop 204 so that the take-up tube 204*b* of the cop 204 is inserted in the tubular member 221. The tray 230 supporting the cop 204 is provided in its lower surface with a hole 230*a* for receiving the disk 222. When the disk 222 is fitted in the hole 230*a* of the tray 230, the tray holder 227 presses the tray 230 against the disk 222 so that the cop 204 is supported in a correct position when the tray 230 is raised by the disk 222. The tray holder 227 comprises a rod 227*c*, a weight 227*a* attached to the upper end of the rod 227*c* , a presser head 227*d* attached to the lower end of the rod 227*c*, a stopper 227*b* limiting the downward movement of the weight 227*a*, and a guide 227*e* vertically slidably supporting the rod 227*c*. When the stopper 227*b* is seated on the guide 227*e*, a clearance is formed between the presser head 227*d* and the tray 230. When the tray 230 is raised together with the disk 222, the weight 227*a* applies pressure to the tray 230 to press the tray 230 at a position C (FIG. 12) against the disk 222, and the weight 227*a* and the presser head 227*d* are raised together with the tray 230. A cop changing mechanism 229, which will be described later, moves the disk vertically, transfers a cop 204 from a cop feed conveyor 211 through a waiting position to the winding position A and transfers an empty bobbin 204'** from the winding position A to an empty bobbin discharging conveyor.

The sensor 224 is disposed so as not to interfere with the cop 204 when the cop 204 is moved to the winding position A and so as to detect the chase **204*a* of the cop 204. The sensor 224, similarly to the tubular member 221 is attached to a frame, not shown. A detection signal provided by the sensor 224 is given to the controller 225, the controller 225 operates a selector valve 226 to push out the rod 223*a* of the cylinder actuator 223 gradually so as to maintain the distance between the lower end of the tubular member 221 and the lower end of the chase 204*a* substantially constant. The sensor 233 is of a diffuse reflection type. As the yarn is unwound from the chase 204*a*, the distance between the sensor 224 and the chase 204*a* increases and, finally, the sensor 224 provides an OFF signal. Upon the reception of the OFF signal from the sensor 224, the controller 225 operates the selector valve 226 so that the rod 223*a* of the cylinder actuator 223 is pushed out. Then, the distance between the sensor 224 and the chase 224*a* decreases and, finally the sensor provides an ON signal. Upon the reception of the 0N signal from the sensor 224, the controller 225 operates the selector valve 226 to stop the rod 223*a* of the cylinder actuator 223. Thus, the rod 223*a* of the cylinder actuator 223 is pushed out gradually to raise the tray 230 supporting the cop 204 gradually and to insert the bobbin 204*b* gradually in the tubular member 221. The sensor 233 for monitoring the chase 204*a*** need not necessarily be held in a horizontal position, but may be held at an optional inclination between a vertical position and a horizontal position.

The cop changing mechanism 229 will be described with reference to FIGS. 11 to 13. FIG. 11 shows one of a plurality of winding units 201 arranged at regular intervals in a row perpendicular to the paper. A cop feed conveyor 211 is extended along the row of the winding units 201, an empty bobbin discharging conveyor 212 is extended along the row of the winding units 201, and cop changing mechanisms 229 are disposed between the cop feed conveyor 211 and the empty bobbin discharging conveyor 212. As shown in FIG. 11, the cop feed conveyor 211 conveys trays 230 respectively supporting cops 204. The cop feed conveyor 211 and the empty bobbin discharging conveyor 212 are extended, respectively, on different levels, and the cop changing mechanism 229 is disposed along a slope between the cop feed conveyor 211 and the empty bobbin conveyor 212. The cop 204 is transferred from the cop feed conveyor 211 to a winding position A in the cop changing mechanism 229, the yarn of the cop 204 is taken up on a yarn package, not shown, by the winding unit 201, and the empty bobbin 208 is transferred from the winding position A onto the empty bobbin discharging conveyor 212.

Figure 12:
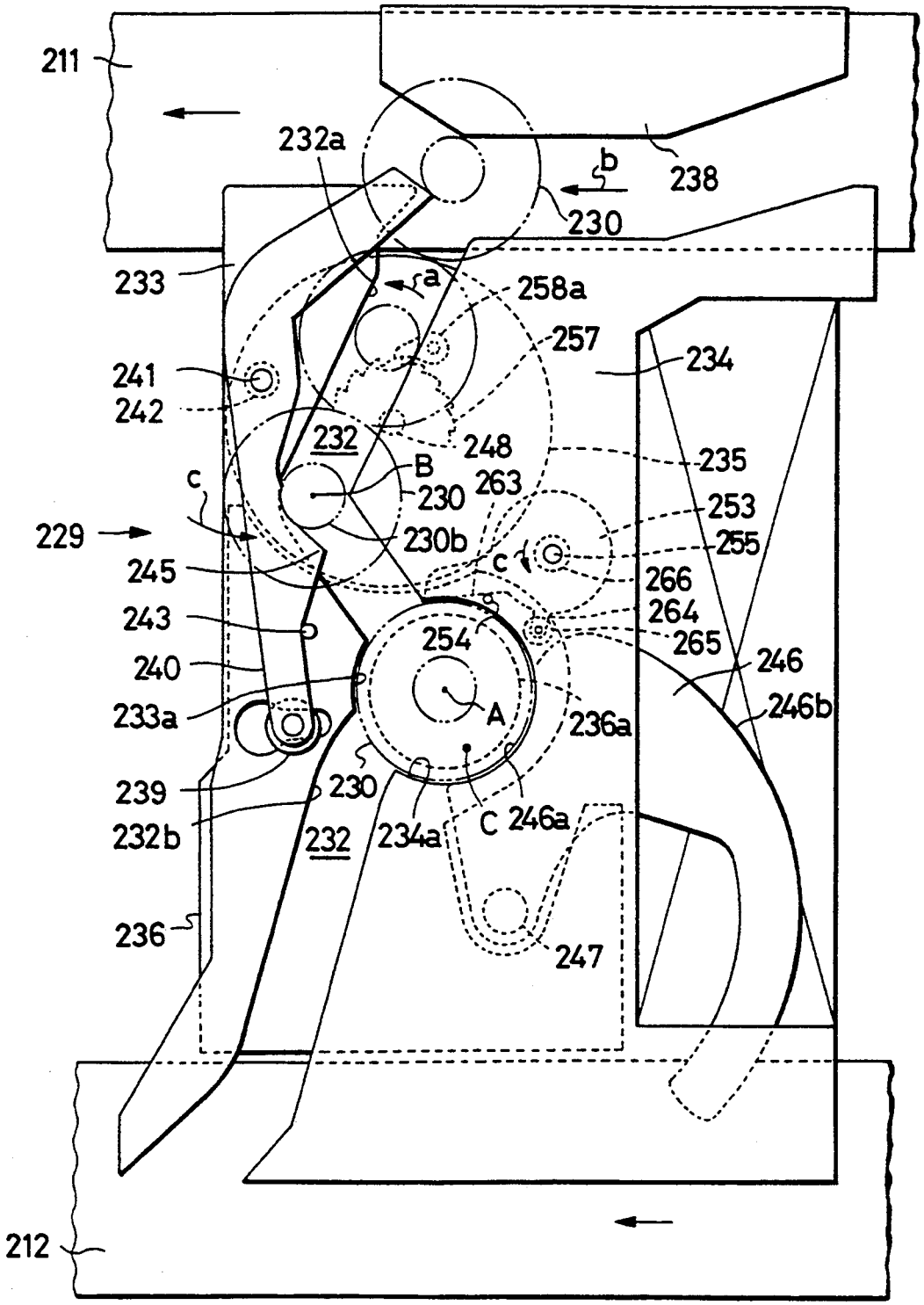
FIG. 12 is a plan view of a cop changing mechanism.
Figure 13:
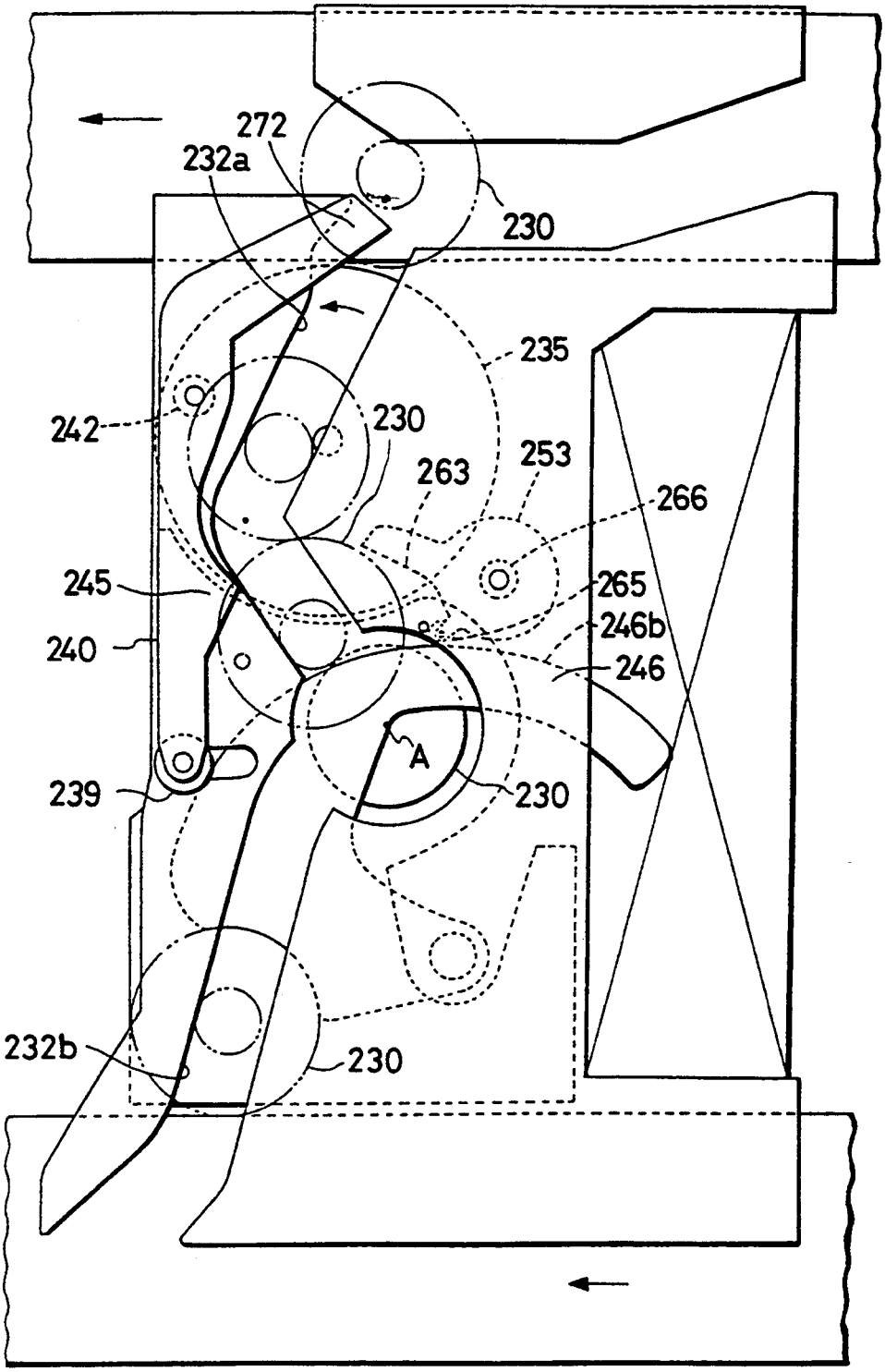
FIG. 13 is a plan view of assistance in explaining the operation of the cop changing mechanism.

Referring to FIG. 12, a first guide plate 233 and a second guide plate 234 are disposed fixedly in the winding unit 201 so as to form a bent passage 232 along which the tray 205 travels. An inclined rotary disk 235 defines the lower surface of a feed passage **232*a*, and a portion of the first guide plate 233 is bent to form a bottom plate 236 defining the respective lower surfaces of an ejecting passage 232b and the winding position A. The cop feed conveyor 211, the inclined rotary disk 235, the bottom plate 236 of the first guide plate 233, a waiting position B, the winding position A and the empty bobbin conveyor 212 are included substantially in an inclined plane. Holes 233a and 234a of a larger diameter allowing the tray 230 to pass through are formed at a position corresponding to the winding position A respectively in the first guide plate 233 and the second guide plate 234, and a hole 236a of a smaller diameter not allowing the tray 230 to pass through is formed in the bottom plate 236 at a position corresponding to the winding position A. A third guide plate 238 is disposed in connection with the cop feed conveyor 211 to guide some of the trays 205 being conveyed in the direction of the arrow b by the cop feed conveyor 211 into the feed passage 232a and to allow the rest of the trays 230** to be conveyed further in the direction of the arrow b.

Referring to FIG. 11, the inclined rotary disk 235 is supported for rotation on a shaft 248 fixed to a bracket 256 projecting from the winding unit 201. A ratchet wheel 257 having a plurality of teeth is attached to the lower surface of the inclined rotary disk 235. A rotary plate 258 pivotally supporting a click 258a is supported for rotation on the shaft 248. A link 259 pushes and pulls the rotary plate 258 to turn the ratchet wheel 257 together with the inclined rotary disk 235 in the direction of the arrow a to move the tray 230 obliquely downward, as viewed in FIG. 11, along the feed passage 232a. A push rod and a rocking arm, not shown, reciprocates the link 259 to turn the inclined rotary disk 235 intermittently.

As shown in FIG. 12, a stopper lever 240 provided at its free end with a free roller 239 is supported for swing motion by a shaft 221 on the first guide plate 233. The stopper lever 240 is biased in the direction of the arrow c by a spring 242 and the turning of the stopper lever 220 in the direction of the arrow c is limited by a pin 243. The stopper lever 240 has a projecting portion 245 that projects into the outlet of a first bend of the passage 232 defining a waiting position B to restrict the width of the outlet of the waiting position B to a width smaller than the diameter of the stepped portion 230b of the tray 230 when the stopper lever 240 rests on the pin 243 to keep two trays 230 always in the feed passage 232a.

A first ejecting lever 253 is supported for turning by a shaft 255 on the second guide plate 234. A second ejecting lever 246 is provided with a recess 246a in which the tray 230 disposed at the winding position A is received and held, and has a roller operating edge 246b having the shape of an arc of a circle having its center on the axis of the shaft 247. As shown in FIG. 11, the shaft 247 supporting the second ejecting lever 246 is turned by means of a push rod 244 and a rocking arm, not shown. The first ejecting lever 253 has a first arm 263 for urging the tray 230 into the recess 246a of the second ejecting lever 246, and a second arm 264 provided at its free end with a free roller 265 that comes into contact with the roller operating edge 246b of the second ejecting lever 246. The first ejecting lever 253 is biased in the direction of the arrow c by a spring 266. The first arm 243 comes into contact with pin 254 to limit the turning of the first ejecting lever 253 in the direction of the arrow c.

As shown in FIG. 11, the disk and the cylinder actuator 223 are disposed under the hole 236a of the bottom plate 236. An annular groove 230c is formed in the side wall of the hole 230a of the tray 230, and a holding member 222c projecting from the outer circumference of the disk 222 engages the annular groove 230c to hold the tray 230 on the disk 222.

The operation of the cop changing mechanism 229 will be described hereinafter. Referring to FIG. 12 showing the cop changing mechanism 229 in a state for the normal winding operation, a first tray 230 is located at the winding position A, and a second tray 230 and a third tray 230 are stored at the waiting position B in the feed passage 232a. The first tray 230 located at the winding position A is held in the recess 246a of the second ejecting lever 246 by the first lever 263 of the first ejecting lever 253. The projecting portion 245 of the stopper lever 240 is in contact with the stepped portion 230b of the second tray 230 to restrain the second tray 230 from moving to the winding position A. In this state, the inclined rotary disk 235 is stationary.

During the winding operation, the disk 222 (FIG. 11) is raised together with the cop 204 by the cylinder actuator 223 as the yarn of the cop 204 is unwound. Upon the exhaustion of the cop 204, the disk 222 is lowered to a position shown in FIG. 11 to locate the first tray 230 supporting an empty bobbin 204' at the winding position A. Then, the second ejecting lever 246 (FIG. 13) is turned counterclockwise to eject the tray 230 from the winding position A through the ejecting passage 232b onto the empty bobbin conveyor 212. As the second ejecting lever 246 is turned counterclockwise, the roller operating edge 246b of the second ejecting lever 246 engages the free roller 265 of the first ejecting lever 253 to retract the first arm 263 to a position shown in FIG. 13. Then the roller operating edge 246a engages the free roller 239 of the stopper lever 240 to shift the projecting portion 245 of the stopper lever 240 to the left. Consequently, the second tray is released from the projecting portion 245, and is advanced as far as the same comes into contact with the roller operating edge 246a by the inclined rotary disk 235 turning intermittently. A projection 272 formed on the other end of the stopper lever 240 opposite the end in which the free roller 239 is supported projects to prevent another tray 230 from entering the feed passage 232a.

Upon the return of the second ejecting lever 246 to its initial position, the spring 266 urges the stopper lever 240 toward its initial position and the first arm 263 shifts the second tray 230 released from the roller operating edge 246a to the winding position A.

Figure 14:
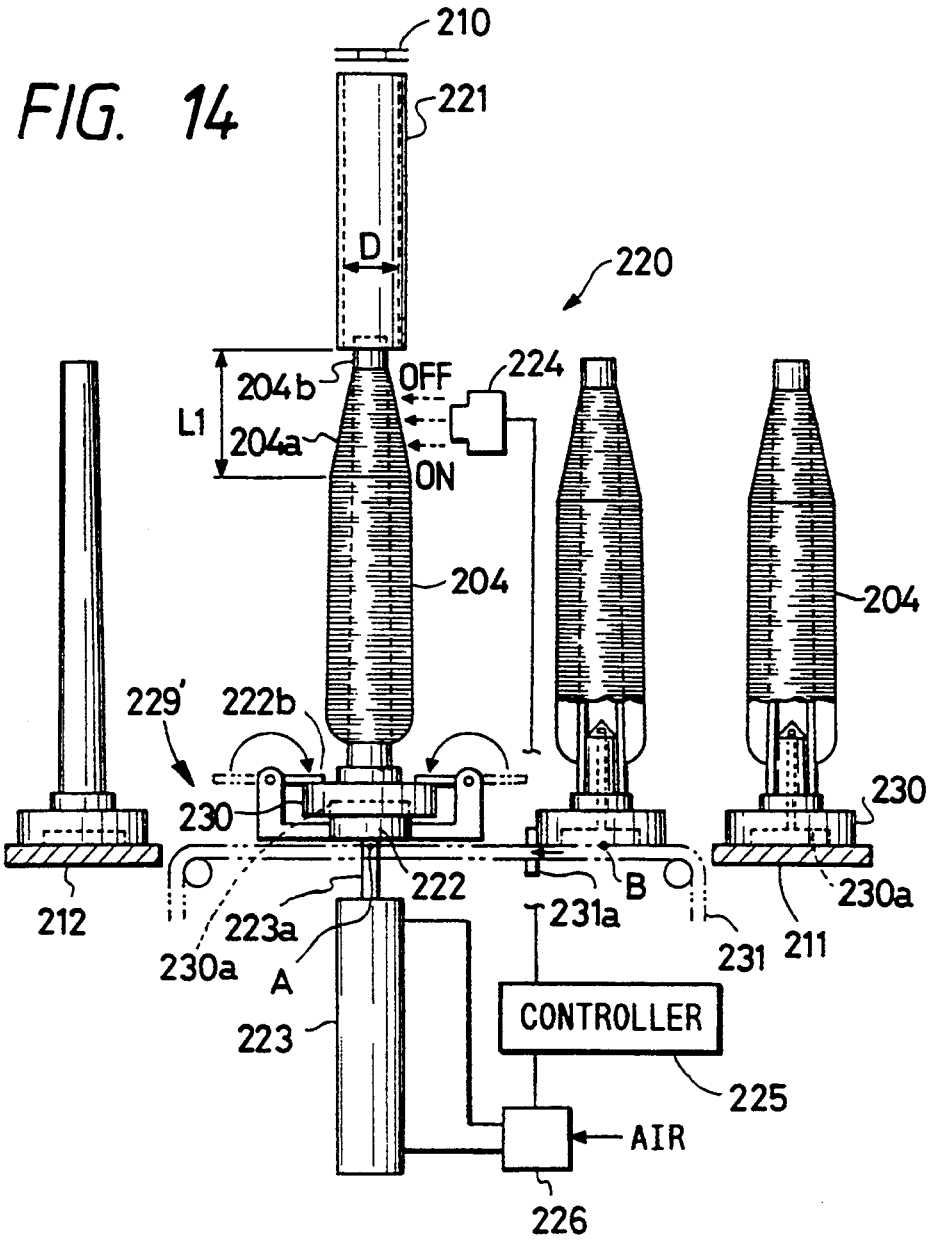
FIG. 14 is a side view of another cop changing mechanism.
Figure 15:
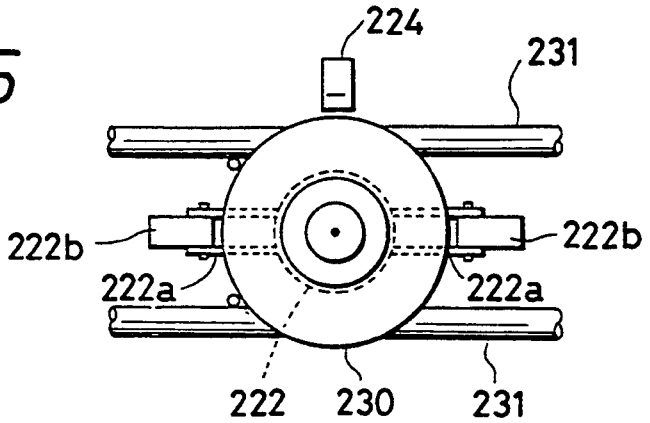
FIG. 15 is a plan view of another cop changing mechanism.

The cop changing mechanism may employ round belts and a stopper instead of the ejecting plates. FIG. 14 is a side view of another cop changing mechanism 229' and FIG. 15 is a plan view of the cop changing mechanism 229'. A winding position A and a waiting position 224 are defined by a retractable stepper 224a on a passage along which round belts 231 travel. Since a space is formed between the round belts 231 as shown in FIG. 15, a tray holder for holding the tray 230 comprises pressure plates 222b pivotally supported by arms 222a on the disk 222. The winding unit is provided with an unwinding assisting device 220 similar to the unwinding assisting device shown in FIG. 11. Parts of the unwinding assisting device 220 shown in FIG. 14 corresponding to those of the unwinding assisting device shown in FIG. 11 are denoted by the same reference characters and the description thereof will be omitted.

Figures 16A, 16B, 16C:
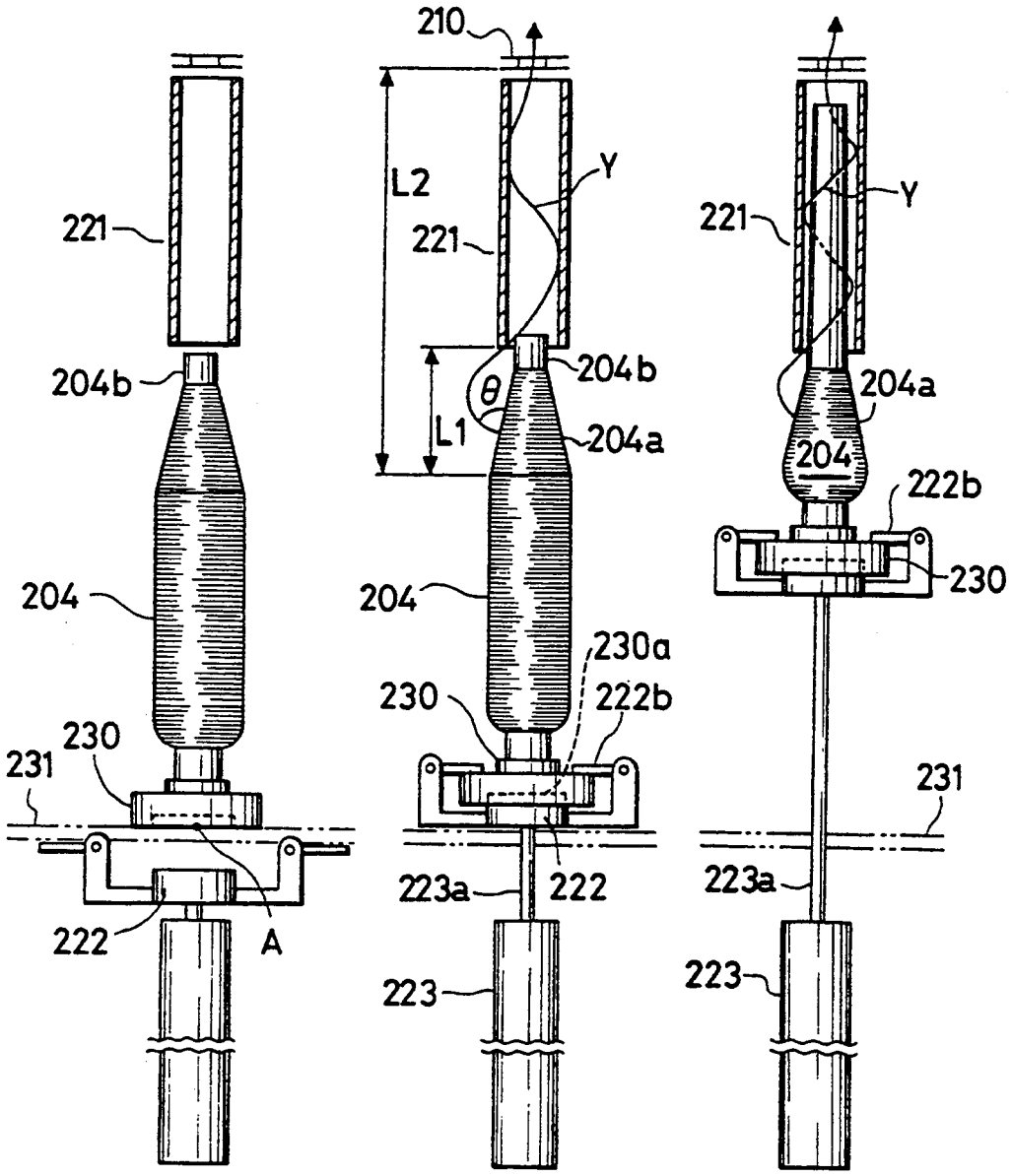
FIGS. 16*a*, 16*b* and 16*c* are side views of assitance in explaining the operation of the unwinding assisting device embodying the present invention.

The operation of the unwinding assisting device 220 shown in FIG. 14 will be described hereinafter with reference to FIGS. 16*a*, 16*b* and 16*c*. Referring to FIG. 16*a*, the disk 222 and the presser plates 222*b* are located at a retracted position under the round belts 231. A tray 230 supporting a cop 204 is conveyed by the round belts 231 to the winding position A. In this state, the lower end of the tubular member 221 is above the bobbin 204*b*, so that the ejection of an empty bobbin and subsequent feed of a cop 204 are not obstructed by the tubular member 221. Referring to FIG. 16*b*, the rod 223*a* of the cylinder actuator 223 is pushed out to fit the disk 222 in the hole 230*a* of the tray 230 and the presser plates 222*b* holds the tray 230 fixedly in place, the upper end of the bobbin 204*b* of the cop 204 is inserted slightly in the tubular member 221, and then the winding operation is started. The lower end of the tubular member 221 is at the predetermined distance L1 from the lower end of the chase 204*a* of the cop 204, so that a relatively large unwinding angle $\theta$ is secured to reduce friction between the yarn being unwound and the layers of the yarn on the cop 204. Accordingly, occurrence of sluffing and fluffing is suppressed. As the yarn is unwound from the cop 204, the cop 204 is raised to maintain the distance L2 between the lower end of the chase 204*a* and the guide plate 210 as well as the distance L1. Accordingly, the balloon formed between the cop 204 and the guide plate 210 by the yarn Y is controlled by the tubular member 221 and the balloon does not vary widely.

FIG. 16*c* shows a $\frac{1}{3}$ cop, namely, an almost exhausted cop having an amount of yarn about $\frac{1}{3}$ times that of the yarn of a full cop. In this state, the shape of the chase 204*a* start changing and the unwinding angle $\theta$ cannot be increased by further raising the cop 204. Therefore, the further extension of the rod 223*a* of the cylinder actuator 223 is stopped to unwind the yarn from the cop 204 without further raising the cop 204. Under such an operation condition, the balloon formed by the yarn Y between the chase 204*b* and the guide plate 210 is still controlled by the tubular member 221. After all the yarn of the cop 204 has been taken up and an empty bobbin remains on the tray 230, the rod 223*a* of the cylinder actuator 223 is retracted, the presser plates 222*b* are removed from the tray 230, the tray 230 supporting the empty bobbin is removed from the winding position by the round belts 231 and, at the same time, a new cop 204 is fed to the winding position as shown in FIG. 16*a*.

The unwinding assisting device for an automatic winder in accordance with the present invention comprises the lifting mechanism for holding a tray supporting a cop at the winding position and raising the tray as the yarn is unwound from the cop, and the tubular member having an inside diameter smaller than the outside diameter of the cop and larger than the outside diameter of the take-up tube of the cop and capable of receiving the take-up tube therein. Since the cop is raised by the lifting mechanism as the yarn is unwound from the cop, the distance between the tubular member and the lower end of the chase remains constant and the balloon is controlled in the state by the tubular member. Thus, increase and variation in the tension of the yarn after the amount of the yarn of the cop has decreased to $\frac{1}{3}$ times that of the full cop can be suppressed and, consequently, the automatic winder is able to operate at a practical winding speed higher than the practical winding speed at which the prior art automatic winder is able to operate.

What is claimed is:

1. A cop changing device for a winding unit, the winding unit defining a winding position and a reference plane, the device comprising:

means for transferring a tray having a cop uprightly supported thereon from a waiting position to the winding position, the cop defining a weight, .

means for moving a tray having an empty bobbin supported thereon away from the winding position, and a tray holder biased for actively pressing a tray located at the winding position in a direction substantially perpendicular to the reference plane to thereby maintain a cop at the winding position in a substantially perpendicular orientation relative to the reference plane regardless of changes in the weight of the cop.

2. The device of claim 1, comprising means for holding a tray at the winding position, the means for holding a tray at the winding position comprising:

a guide plate having a recess formed therein, and a first ejecting lever having a first arm for pressing a tray against the recess, the tray holder being provided on the first arm.

3. The device of claim 2, comprising:

a bottom plate spaced from the guide plate, the bottom plate and the guide plate defining a space therebetween, a shaft to which the first arm is fixed, a second arm for ejecting a tray from the winding position, the second arm being fixed to the shaft and extending in the space between the bottom plate and the guide plate, and a spring for biasing the first arm and the second arm.

4. The device of claim 2, wherein the first arm defines a stepped hole and wherein the tray holder comprises:

a pressing member provided with a flange and configured to be received in the stepped hole defined in the first arm, a cover member, and a compression spring compressed between the pressing member and the cover member.

5. The device of claim 1, comprising means for holding a tray at the winding position, the means for holding a tray at the winding position comprising:

an inclined bottom plate, a guide plate having an upper surface and a recess formed therein, and a first ejecting lever having a first arm for pressing a tray against the recess, the tray holder being provided on the guide plate and further comprising:

a housing fastened to the upper surface of the guide plate and defining a stepped hole, a pressing member configured to be received in the stepped hole, a spring configured to be received in the stepped hole, and a cover member for holding the pressing member and the spring in the stepped hole, whereby the extremity of the pressing member is biased toward the upper surface of a tray.

* * * * *